United States Patent [19]

Gaynor

[11] 4,350,400

[45] Sep. 21, 1982

[54] CONNECTOR FOR CIRCULAR FLUORESCENT LAMP

[76] Inventor: Edwin S. Gaynor, 688 Hulls Farm Rd., Southport, Conn. 06490

[21] Appl. No.: 283,334

[22] Filed: Jul. 14, 1981

[51] Int. Cl.[3] ..... H01R 33/08

[52] U.S. Cl. ..... 339/50 C; 339/95 D

[58] Field of Search ..... 339/50 C, 53, 95 D

[56] References Cited

U.S. PATENT DOCUMENTS 3,292,097 12/1966 Gaynor ..... 339/53

*Primary Examiner*—Joseph H. McGlynn
*Assistant Examiner*—Frank H. McKenzie, Jr.
*Attorney, Agent, or Firm*—Kenyon & Kenyon

[57] ABSTRACT

A four terminal female connector for circular fluorescent lamps has a molded plastic support body of cruciform cross section. Four elongated terminals stamped from a metal strip are disposed in respective terminal-receiving channels in the four quadrants of the cruciform body. A molded plastic housing slidably encloses the body and terminals. One end of each terminal is formed with a hooked portion for push-in engagement of an electrical lead wire. The other end of each terminal has two arms bent inwardly from opposite sides of the base of the strip to form a prong-engaging channel for a mating male connector. The base of the prong-engaging channel is angled slightly with respect to the longitudinal axis of the connector to provide a flared contact surface for facilitating entry of a male connector.

7 Claims, 5 Drawing Figures

Fig. 1
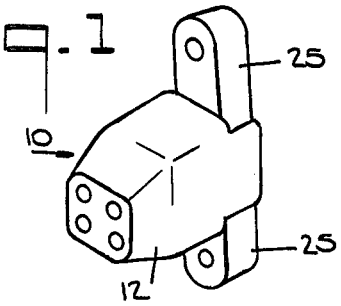
Fig. 5.
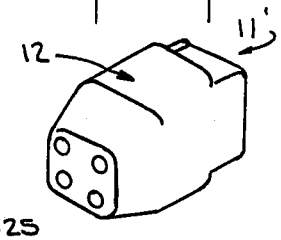
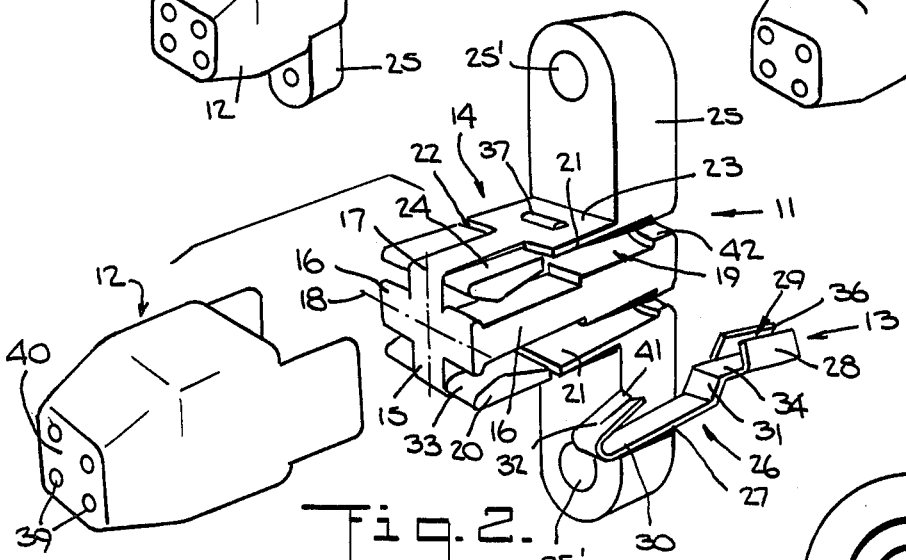
Fig. 2.
Fig. 4.
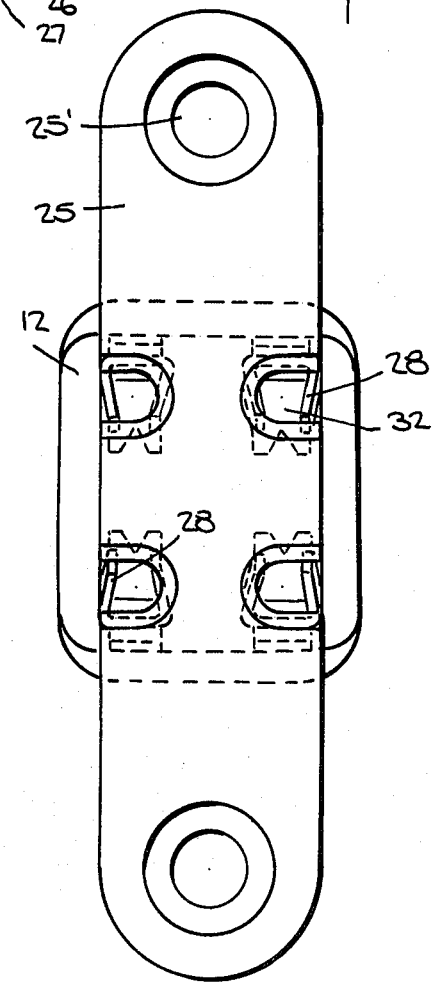
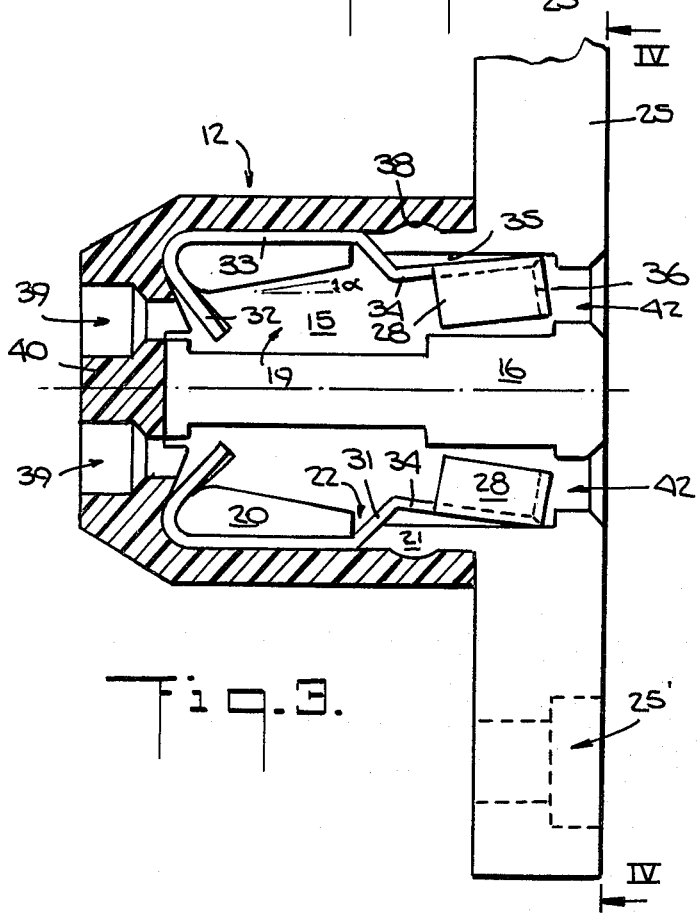
Fig. 3.

CONNECTOR FOR CIRCULAR FLUORESCENT LAMP

BACKGROUND OF THE INVENTION

1. Technical Field

This invention relates to electrical connectors for fluorescent lamps, and particularly to a connector for a circle-line type of fluorescent lamp in which a glass tube is formed in a circle, with the ends of the tube joined by a socket having four projecting electrical contact pins arranged in a rectangular pattern.

2. Background Art

One style of conventional four terminal female connector for circular fluorescent lamps is disclosed in U.S. Pat. No. 3,292,097 issued to E. G. Gaynor on Dec. 13, 1966. The connector shown in this patent includes a body member having four longitudinally extending terminal-receiving passages and a cap fitted into a recess in the body member to enclose the terminal passages. Each terminal is formed from a metal strip and has an elongated flat base extending the length of the terminal, a pair of converging clamping arms extending from the base at one end of the terminal adjacent to an opening in the end of the body for receiving a corresponding prong of a fluorescent lamp, and a pair of diverging arms extending from the base at the other end of the terminal.

Electrical leads extend through openings in the cap and are soldered to the other end of each terminal. The cap is fastened to the body by a screw, and the diverging arms serve to lock the terminals against the inner face of the cap to withstand any pull on the electrical leads.

The soldered-lead connector of the Gaynor 3,292,097 patent has been superseded by a push-in style of connector in which each electrical lead is frictionally engaged by a hooked end of the corresponding terminal, which holds the lead, by a wedging action, against being pulled out after insertion.

The newer style connector includes a molded plastic terminal support having a body formed with four parallel elongated terminal-receiving open channels. The body slides into a molded plastic housing, which locks to the body by a snap fit between an integrally molded protrusion on the body and a mating recess in the housing.

Each terminal of the new style connector is formed from a metal strip having parallel longitudinal edges, with a pair of converging arms extending from the longitudinal edges at one end to form a prong-engaging portion similar to that shown in the Gaynor 3,292,097 patent.

The remainder of the metal strip, which forms a base for the terminal, extends from the prong-engaging portion and includes a stepped offset portion, a flat longitudinally extending portion, and a bent-back hooked end. The offset portion fits in a transverse gap between first and second longitudinally extending flange-like members on the body of the terminal support, the flat portion fits along an outer surface of the first flange-like member, and the hooked portion fits around the first flange-like member at one end of the terminal support body and extends at an acute angle into the terminal-receiving channel. The prong-engaging portion is also disposed in the terminal-receiving channel adjacent to the other end of the channel, with its axis parallel to the channel axis.

The newer style connector provides manufacturing economies over the earlier Gaynor 3,292,097 connector by eliminating the soldered lead connections. Also, the offset design of each terminal base, allowing the hooked end of the terminal to be fitted around the outside of the above-described first flange-like member provides a secure mounting for the terminal to resist both longitudinal and transverse movement in its channel.

It was found, however, that the new style of four terminal female connector was commercially unacceptable because of interference between the prong-receiving portion and male prong-type connectors due to lumps of solder that are often left on the tips of the prongs during the lamp manufacturing process. It is an object of the present invention, therefore, to provide a four terminal female connector of improved design, which retains the advantageous rigidity of "wrap around" terminal mounting yet eliminates any possibility of interference when the connector is assembled to the prongs of a lamp.

SUMMARY OF THE INVENTION

The present invention provides a four terminal female connector for a fluorescent lamp, the connector comprising a terminal support and a housing, each of molded synthetic resin, and four metal terminals.

The terminal support has an elongated body of generally cruciform cross section formed by first and second mutually perpendicular walls intersecting at their midplanes, said midplanes defining four symmetrically arranged quadrants, and first and second flange-like members extending from the first wall in spaced relation to the second wall in each quadrant adjacent to one and the other ends of the body, respectively, each second flange-like member being spaced longitudinally from the corresponding first flange-like member.

The housing is hollow and has an open end for telescopically receiving the body of the terminal support, said body slidably fitting within the housing.

Each terminal comprises an elongated member removably fitted in a corresponding quadrant of the terminal support body, each terminal being formed from a metal strip with parallel longitudinal edges, the strip having

- a flat portion fitting along the surface of the respective first flange-like member on the side thereof opposite to the second wall in the corresponding quadrant,
- a hooked portion formed as a bent back extension of and making an acute angle with the flat portion, said hooked portion being fitted around the first flange-like member adjacent to the one end of said body of the terminal support and extending into the space between the first flange-like member and the second wall,
- an offset portion extending from the flat portion through the space between the first and second flange-like members, and
- a prong-receiving portion extending longitudinally from the offset portion between the second flange-like member and the second wall to adjacent the other end of said body, the prong-receiving portion including an integral arm extending from each longitudinal edge of the strip, said arms being bent inwardly generally along the line of the respective longitudinal edge to form a channel for frictionally engaging a corresponding prong of a male connector fitting, wherein the part of the strip forming the prong-receiving portion is angled relative to the midplane of the second wall to provide a flared contact surface for facilitating entry of a corresponding male connector prong into said prong-engaging channel.

The angle between the part of the strip forming the prong-receiving portion and the midplane of the second wall is preferably in the range of approximately 5° to 15°, and most preferably in the range of approximately 7° to 11°.

In addition, the entry edge of the prong-receiving portion is preferably chamfered to further facilitate mating engagement of the connector with its male counterpart.

These and other features and advantages of the present invention will be more clearly understood from the drawings and the following description of the preferred embodiments.

BRIEF DESCRIPTION OF THE DRAWINGS

FIG. 1 is a perspective view of an assembled connector having integral mounting lugs.

FIG. 2 is an exploded view of the connector of FIG. 1 after disassembly, showing the housing, terminal support, and one of the four terminals.

FIG. 3 is a side view, with the housing in cross section, of the assembled connector of FIG. 1.

FIG. 4 is an end view, in the direction of arrows IV—IV in FIG. 3, of the assembled connector of FIG. 1.

FIG. 5 is a perspective view of an assembled alternative embodiment of the connector without mounting lugs.

DESCRIPTION OF THE PREFERRED EMBODIMENTS

With reference to FIGS. 1 to 4, and particularly to FIG. 2, a four terminal female connector 10 embodying the present invention includes a terminal support 11 molded of synthetic resin, a housing 12, also molded of synthetic resin, and four identical metal terminals 13.

The terminal support 11 has an elongated body 14 of generally cruciform cross section, as shown clearly in FIG. 2, resulting from the mutually perpendicular intersection of a first wall 15 and a second wall 16 at their midplanes (denoted by broken lines 17 and 18, respectively). These midplanes divide the body into four symmetrically arranged quadrants, each of which accommodates one of the terminals 13 in a respective open channel 19. Each channel 19 is bounded on one side by a respective surface of the second wall and on the other side by a first flange-like member 20 extending from the first wall 15 adjacent to one end of the body and a second flange-like member 21 extending from wall 15 adjacent to the other end of the body. The first and second flange-like members of each quadrant are disposed generally in tandem relation, with a transverse gap 22 between their inner ends. The outer surface 23 of each second flange-like member 21 is coplanar with the adjacent edge of wall 15, but the outer surface 24 of each first flange-like member 20 is inset slightly from the adjacent edge of wall 15.

The embodiment of FIGS. 1–4 includes two integral wings or lugs 25, each having a stepped hole 25′ for accepting an appropriate fastener (e.g., a machine screw or a rivet) for attaching the connector to a support base (not shown). This embodiment is particularly suited for installations in which the connector provides both the electrical connection and the support for a circular fluorescent lamp. In other cases, particularly for the larger sizes of circular lamps, other support means are provided for the circular lamps, and the connector can be used as a so-called "floating" connector. In such a situation the wings 25 can be eliminated, as shown in the alternative embodiment of FIG. 5.

Each terminal 13 is formed from an elongated strip 26 of metal having good electrical conductivity and also a relatively high modulus of elasticity, that is, a relatively "springy" metal. A preferred material for the terminals is a phosphor bronze alloy of the type conventionally used for electrical spring terminals.

The elongated strip 26 of each terminal has parallel longitudinal edges 27, with an integral flap or arm 28 extending from each edge 27 at one end of the strip, the arms 28 being bent inwardly generally along the line of the respective longitudinal edges to form a channel 29 for frictionally engaging a corresponding prong of a male connector (not shown).

The remainder of the strip 26 is formed into a flat portion 30, a stepped or offset portion 31 joining the flat portion to the prong-receiving channel 29, and a hooked portion 32 formed as a bent back extension of, and making an acute angle with, the flat portion 30.

The dimensions of terminals 13 are selected so that the prong-receiving portion of each terminal may be installed in a receiving channel 19 of the terminal support body with the offset portion 31 extending through the transverse gap 22, the flat portion of the terminal fitting along outer surface 24 of the first flange-like member, and the hooked portion 32 fitting around a radiused surface 33 of the flange member 20 adjacent to the one end of the body and extending back into the space between the flange member 20 and the second wall 16, as best shown in FIG. 3.

The terminal should fit snugly around the flange member 20; its springiness allowing it to slide onto the first flange member easily and also to grip the member, thereby firmly anchoring the terminal to the support body with no play between the terminal and the first flange at that end of the body.

The prong-receiving portion, on the contrary, fits relatively loosely between the second flange-like member 21 and the second wall 16. In the connectors of this type discussed earlier, in the description of the background art, the part of the elongated strip 26 extending from the offset portion 31 and serving as a base 34 for the pair of inwardly bent arms 28 was formed parallel to the plane of the flat portion 30 but offset from that plane by the offset portion 31. Although the loose fit of this prong-receiving portion should have allowed the connector to accept even out-of-tolerance male connector prongs, it was found that such connectors were not usable with all brands of circular fluorescent bulbs.

In particular, the connector prongs of cheaply-made lamps often have lumps of solder at their outer tips remaining from the final manufacturing operation of soldering the filament leads of the lamp in the prongs. These solder lumps would prevent easy assembly of the lamp to the female connector. Since this problem could often arise when the purchaser of a lighting fixture containing the female connector attempted to replace a burned out fluorescent lamp, this problem rendered the connectors commercially unacceptable.

The problem has been solved by forming the terminal so that base 34 of the prong-receiving portion is angled outward relative to the midplane of the second wall 16

(indicated by angle $\alpha$ in FIG. 3) to provide a flared contact surface for facilitating entry of a corresponding male connector prong into the prong engaging channel.

The value of the angle $\alpha$ need be only enough to assure that the end of the prong-receiving portion bears firmly against the inner surface 35 of the second flange-like member 21. The angle may be between approximately 5° and approximately 15°. Preferably, the angle is between about 7° and 11°. It should not be greater than 15°, and preferably 11°, or considerable difficulty will be encountered in assembling the terminals in the support body. It should not be less than 5°, and preferably 7°, or easy prong engagement cannot be assured in all cases.

To provide additional ease of lead-in, it is also desirable to provide the entry edge of the prong-receiving portion of each terminal with an internal chamfer 36 (see FIG. 3).

With the improved arrangement of the present invention, the terminals 13 can be easily assembled into the support body 14, as shown in FIG. 3. The housing 12 is then slidingly fitted over the one end of the body 14 until a protrusion 37 molded on the outer surface of body 14 snaps into engagement with a mating recess 38 in the inner surface of the housing.

After assembly of the connector, insulation-stripped ends of electrical lead wires (not shown) can be inserted into holes 39 in end face 40 of the housing and pushed between the ends of the hooked portions 32 and the adjacent side of second wall 16. The ends of the hooked portions 32 are preferably notched (see FIG. 4), and the hooked portions are desirably folded slightly to create a longitudinally extending shallow valley 41 (FIG. 2) to facilitate the push-in connection and to increase the gripping ability of the hooked portion to withstand a pull-out force on the electrical leads.

The leads of the assembled connector can then be connected to appropriate wiring in a lighting fixture and a fluorescent lamp connected by inserting the prongs of the male lamp connector through grooves 42 formed in the other end of the terminal support body 14 in alignment with the terminal-receiving channels 19. Because the entry edge of the base 34 of the prong-receiving portion of each terminal pressed against the inner surface 35 of the adjacent second flange-like member, it is impossible for any solder lump at the tip of a prong to catch on that edge. If there is a solder lump oriented to catch against the entry edge of either of the channel arms 28, this will not prevent insertion of the prong because the arms are sufficiently flexible to bend outwardly enough for the prong to enter the channel.

I claim:

1. A four terminal female connector for a fluorescent lamp, the connector comprising:

a terminal support of molded synthetic resin having an elongated body of generally cruciform cross section formed by first and second mutually perpendicular walls intersecting at their midplanes, said midplanes defining four symmetrically arranged quadrants, and first and second flange-like members extending the first wall in spaced relation to the second wall in each quadrant adjacent to one and the other ends of the body, respectively, each second flange-like member being spaced longitudinally from the corresponding first flange-like member;

a hollow housing of molded synthetic resin having an open end for telescopically receiving the body of said terminal support, said body slidably fitting within said housing; and an elongated electrically conductive terminal removably fitted in each quadrant of the terminal support body, each terminal being formed from a metal strip with parallel longitudinal edges, the strip having a flat portion fitting along the surface of the respective first flange-like member on the side thereof opposite to the second wall in the corresponding quadrant, a hooked portion formed as a bent back extension of and making an acute angle with the flat portion, said hooked portion being fitted around the first flange-like member adjacent to the one end of said body of the terminal support and extending into the space between the first flange-like member and the second wall, an offset portion extending from the flat portion through the space between the first and second flange-like members, and a prong-receiving portion extending longitudinally from the offset portion between the second flange-like member and the second wall to adjacent the other end of said body, the prong-receiving portion including an integral arm extending from each longitudinal edge of the strip, said arms being bent inwardly generally along the line of the respective longitudinal edge to form a channel for frictionally engaging a corresponding prong of a male connector fitting, wherein the part of the strip forming the prong-receiving portion is angled relative to the midplane of the second wall to provide a flared contact surface for facilitating entry of a corresponding male connector prong into said prong-engaging channel.

2. A female connector according to claim 1 wherein the angle between the part of the strip forming the prong-receiving portion and the midplane of the second wall is in the range of approximately 5° to 15°.

3. A female connector according to claim 1 wherein the angle between the part of the strip forming the prong-receiving portion and the midplane of the second wall is in the range between approximately 7° and 11°.

4. A female connector according to claim 1 wherein the entry edge of the prong-receiving portion of each terminal is internally chamfered to further faciliate entry of a corresponding male connector prong.

5. A four-terminal female connector for a fluorescent lamp, the connector comprising:

a terminal support of molded synthetic resin having a body formed with four parallel elongated terminal-receiving channels disposed symmetrically in respective quadrants defined by mutually perpendicular planes whose intersection coincides with a longitudinal axis of the body;

a cover of molded synthetic resin slidably fitting with said body to enclose said terminal-receiving channels; and an elongated terminal disposed in each terminal-receiving channel, each terminal being formed from a metal strip including an elongated base extending longitudinally in the channel, the base having parallel longitudinal edges and an integral arm extending from each longitudinal edge at one end of the base, said arms being bent inwardly along the line of each longitudinal edge to form a channel for frictionally engaging a corresponding prong of a male connector fitting, and the other end of said base being formed for connecting said terminal to a corresponding circuit lead, wherein the improvement comprises:

the one end of said terminal base being angled relative to the longitudinal axis of the terminal-receiving channel to provide a flared entry for a corresponding male connector prong into said prong-engaging channel.

6. A female connector according to claim 5 wherein the angle of the base at the one end of each terminal relative to the longitudinal axis of the terminal receiving channel is in the range of approximately 5° to 15°.

7. A female connector according to claim 6 wherein said angle is in the range of approximately 7° to 11°.

* * * * *